US010102795B2

(12) United States Patent
Chang et al.

(10) Patent No.: US 10,102,795 B2
(45) Date of Patent: Oct. 16, 2018

(54) OPERATING METHOD OF DISPLAY DEVICE AND DISPLAY DEVICE

(71) Applicant: MIKRO MESA TECHNOLOGY CO., LTD., Apia (WS)

(72) Inventors: Chun-Yi Chang, Tainan (TW); Li-Yi Chen, Tainan (TW)

(73) Assignee: MIKRO MESA TECHNOLOGY CO., LTD., Apia (WS)

( * ) Notice: Subject to any disclaimer, the term of this patent is extended or adjusted under 35 U.S.C. 154(b) by 146 days.

(21) Appl. No.: 15/173,729

(22) Filed: Jun. 6, 2016

(65) Prior Publication Data

US 2017/0352309 A1 Dec. 7, 2017

(51) Int. Cl.
*G09G 3/32* (2016.01)
*G09G 3/3291* (2016.01)

(52) U.S. Cl.
CPC ..... *G09G 3/32* (2013.01); *G09G 2300/0809* (2013.01); *G09G 2300/0871* (2013.01); *G09G 2310/067* (2013.01)

(58) Field of Classification Search
CPC ..... G09G 3/32; G09G 2300/0809; G09G 2300/0871; G09G 2310/67
See application file for complete search history.

(56) References Cited

U.S. PATENT DOCUMENTS

2008/0284691 A1* 11/2008 Chung ..... G09G 3/3291 345/76
2009/0009504 A1* 1/2009 Thiebaud ..... G09G 3/3233 345/212
2013/0016086 A1* 1/2013 Ebisuno ..... G09G 3/3225 345/212
2014/0265860 A1* 9/2014 Lethellier ..... H05B 33/0815 315/121
2017/0039935 A1* 2/2017 Yang ..... G09G 3/32
2017/0301296 A1* 10/2017 Pappas ..... G09G 3/3266

* cited by examiner

*Primary Examiner* — Lixi C Simpson
(74) *Attorney, Agent, or Firm* — CKC & Partners Co., Ltd.

(57) ABSTRACT

An operating method of a display device includes providing a first supply voltage to a light emitting diode to make a driving current pass through the light emitting diode. The light emitting diode is electrically connected with an electrically controlled switch, the electrically controlled switch is electrically connected with a control circuit, the control circuit is configured to drive the electrically controlled switch according to a data signal and a scan signal, the first supply voltage is a pulse width modulation voltage, and a duty cycle of the first supply voltage is less than 100%.

39 Claims, 7 Drawing Sheets

OPERATING METHOD OF DISPLAY DEVICE AND DISPLAY DEVICE

BACKGROUND

Technical Field

The present disclosure relates to a method and an electronic component. More particularly, the present disclosure relates to an operating method and a display device.

Description of Related Art

With advances in electronic technology, display devices are being increasingly used.

A typical display device includes a pixel array with pixel circuits. Each of the pixel circuits in the pixel array includes a driving transistor and a light emitting diode. The driving transistor is configured for being operated according to a data voltage and a supply voltage, so as to make a driving current pass through the light emitting diode and drive the light emitting diode. With such operation, the light emitting diodes in the display device are able to emit light and display images.

SUMMARY

One aspect of the present disclosure is related to an operating method of a display device. In accordance with one embodiment of the present disclosure, the operating method includes providing a first supply voltage to a light emitting diode to make a driving current pass through the light emitting diode. The light emitting diode is electrically connected with an electrically controlled switch, the electrically controlled switch is electrically connected with a control circuit, and the control circuit is configured to drive the electrically controlled switch according to a data signal and a scan signal. The first supply voltage is a pulse width modulation voltage, and a duty cycle of the first supply voltage is less than 100%.

In accordance with one embodiment of the present disclosure, the first supply voltage is a periodical voltage.

In accordance with one embodiment of the present disclosure, the first supply voltage has sine waves.

In accordance with one embodiment of the present disclosure, the first supply voltage has rectangular waves.

In accordance with one embodiment of the present disclosure, the first supply voltage has sawtooth waves.

In accordance with one embodiment of the present disclosure, the first supply voltage has triangular waves.

In accordance with one embodiment of the present disclosure, the first supply voltage has a combination of sine waves, rectangular waves, sawtooth waves, and triangular waves.

In accordance with one embodiment of the present disclosure, the first supply voltage comprises a first periodic signal and a second periodic signal, and phases of the first periodic signal and the second periodic signal are different.

In accordance with one embodiment of the present disclosure, duty cycles of the first periodic signal and the second periodic signal are different.

In accordance with one embodiment of the present disclosure, magnitudes of the first periodic signal and the second periodic signal are different.

Another aspect of the present disclosure is related to a display device. In accordance with one embodiment of the present disclosure, the display device includes a transparent substrate, a plurality of scan lines, a plurality of data lines, and a plurality of pixels. The pixels are electrically connected to the scan lines and the data lines. At least one of the pixels includes a light emitting diode, an electrically controlled switch, and a control circuit. The light emitting diode is configured to receive a first supply voltage. The electrically controlled switch is electrically connected with the light emitting diode. The control circuit is electrically connected to the electrically controlled switch, configured to drive the electrically controlled switch according to a data signal from one of the data lines and a scan signal from one of the scan lines. The first supply voltage is a pulse width modulation voltage, and a duty cycle of the first supply voltage is less than 100%.

In accordance with one embodiment of the present disclosure, the first supply voltage is a periodical voltage.

In accordance with one embodiment of the present disclosure, the first supply voltage has sine waves.

In accordance with one embodiment of the present disclosure, the first supply voltage has rectangular waves.

In accordance with one embodiment of the present disclosure, the first supply voltage has sawtooth waves.

In accordance with one embodiment of the present disclosure, the first supply voltage has triangular waves.

In accordance with one embodiment of the present disclosure, the first supply voltage has a combination of sine waves, rectangular waves, sawtooth waves, and triangular waves.

In accordance with one embodiment of the present disclosure, the first supply voltage comprises a first periodic signal and a second periodic signal, and phases of the first periodic signal and the second periodic signal are different.

In accordance with one embodiment of the present disclosure, duty cycles of the first periodic signal and the second periodic signal are different.

In accordance with one embodiment of the present disclosure, magnitudes of the first periodic signal and the second periodic signal are different.

Another aspect of the present disclosure is related to a display device. In accordance with one embodiment of the present disclosure, the display device includes a light emitting diode, an electrically controlled switch, and a control circuit. The light emitting diode is configured to receive a supply voltage. The electrically controlled switch is electrically connected with the light emitting diode. The control circuit is electrically connected to the electrically controlled switch, configured to drive the electrically controlled switch according to a data signal and a scan signal. The supply voltage has a duty cycle less than 100%.

In accordance with one embodiment of the present disclosure, the supply voltage is alternatively converted between more than one voltage levels.

In accordance with one embodiment of the present disclosure, the supply voltage is converted between more than one voltage levels periodically.

In accordance with one embodiment of the present disclosure, under a first condition that the supply voltage has a first voltage level and the electrically controlled switch is switched on, the supply voltage with the first voltage level drives the light emitting diode, and under a second condition that the supply voltage has a second voltage level and the electrically controlled switch is switched on, the supply voltage with the second voltage level fails to drive the light emitting diode.

In accordance with one embodiment of the present disclosure, the supply voltage has sine waves.

In accordance with one embodiment of the present disclosure, the supply voltage has rectangular waves.

In accordance with one embodiment of the present disclosure, the supply voltage has sawtooth waves.

In accordance with one embodiment of the present disclosure, the supply voltage has triangular waves.

In accordance with one embodiment of the present disclosure, the supply voltage has a combination of sine waves, rectangular waves, sawtooth waves, and triangular waves.

In accordance with one embodiment of the present disclosure, the first supply voltage comprises a first periodic signal and a second periodic signal, and phases of the first periodic signal and the second periodic signal are different.

In accordance with one embodiment of the present disclosure, duty cycles of the first periodic signal and the second periodic signal are different.

In accordance with one embodiment of the present disclosure, magnitudes of the first periodic signal and the second periodic signal are different.

Another aspect of the present disclosure is related to an operating method of a display device. In accordance with one embodiment of the present disclosure, the operating method includes providing a first supply current to a light emitting diode. The light emitting diode is electrically connected with an electrically controlled switch, the electrically controlled switch is electrically connected with a control circuit, and the control circuit is configured to drive the electrically controlled switch according to a data signal and a scan signal. The first supply current is a pulse width modulation current, and a duty cycle of the first supply current is less than 100%.

In accordance with one embodiment of the present disclosure, the first supply current is a periodical current.

In accordance with one embodiment of the present disclosure, the first supply current is has one of sine waves, rectangular waves, sawtooth waves, triangular waves, and combinations thereof.

In accordance with one embodiment of the present disclosure, the first supply current comprises a first periodic signal and a second periodic signal, and phases of the first periodic signal and the second periodic signal are different.

In accordance with one embodiment of the present disclosure, duty cycles of the first periodic signal and the second periodic signal are different.

In accordance with one embodiment of the present disclosure, magnitudes of the first periodic signal and the second periodic signal are different.

Another aspect of the present disclosure is related to a display device. In accordance with one embodiment of the present disclosure, the display device includes a light emitting diode, an electrically controlled switch, and a control circuit. The light emitting diode is configured to receive a supply current. The electrically controlled switch is electrically connected with the light emitting diode. The control circuit is electrically connected to the electrically controlled switch, configured to drive the electrically controlled switch according to a data signal and a scan signal. The supply current has a duty cycle less than 100%.

In accordance with one embodiment of the present disclosure, the first supply current is a periodical current.

In accordance with one embodiment of the present disclosure, the first supply current is has one of sine waves, rectangular waves, sawtooth waves, triangular waves, and combinations thereof.

In accordance with one embodiment of the present disclosure, the first supply current comprises a first periodic signal and a second periodic signal, and phases of the first periodic signal and the second periodic signal are different.

In accordance with one embodiment of the present disclosure, duty cycles of the first periodic signal and the second periodic signal are different.

In accordance with one embodiment of the present disclosure, magnitudes of the first periodic signal and the second periodic signal are different.

Through an application of one embodiment described above, the magnitude of the driving current can be increased, so that the display quality of the display device can be improved.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
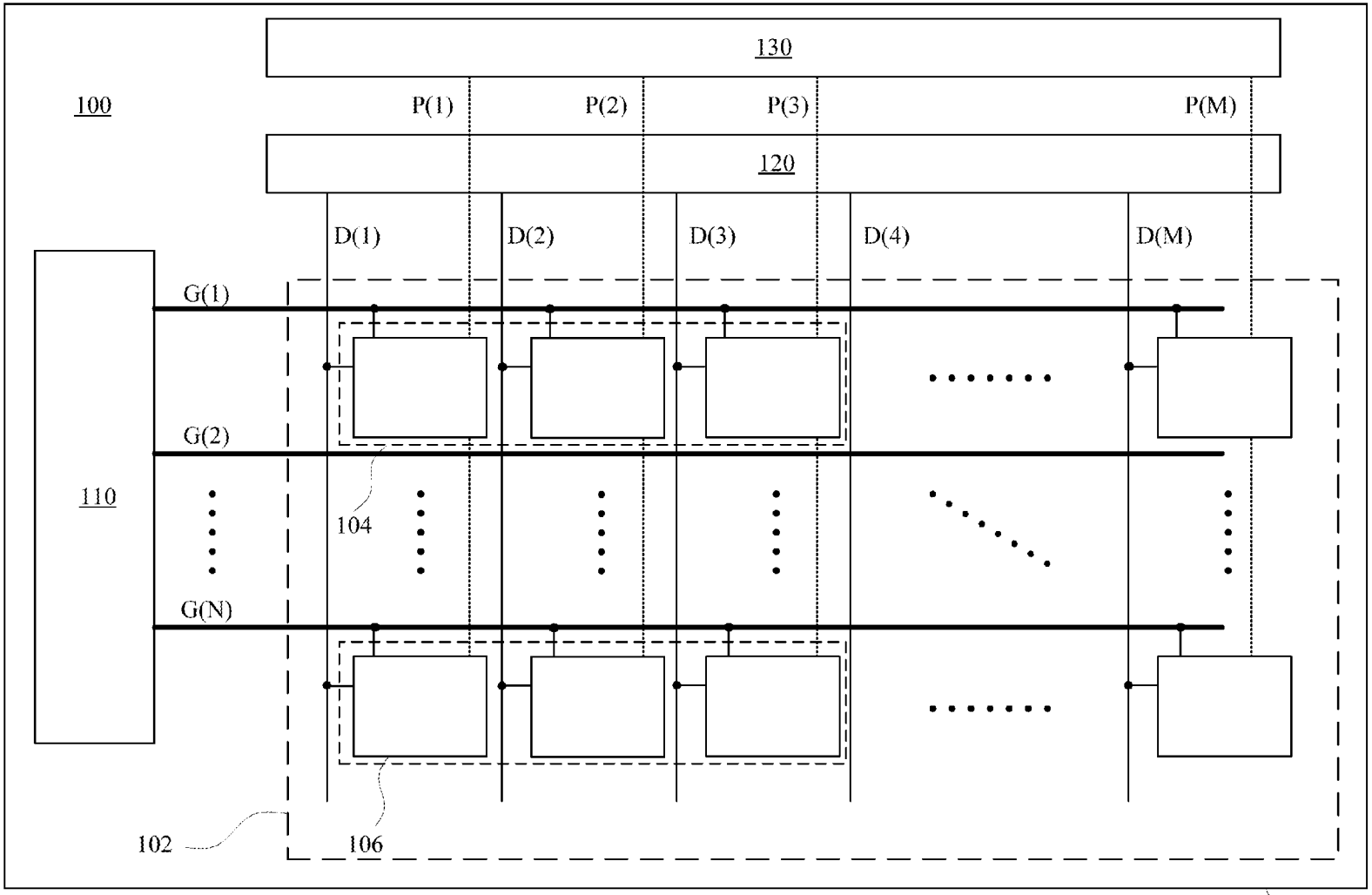
FIG. 1 is a schematic diagram of a display device in accordance with one embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

It will be understood that, in the description herein and throughout the claims that follow, when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Moreover, "electrically connect" or "connect" can further refer to the interoperation or interaction between two or more elements.

It will be understood that, in the description herein and throughout the claims that follow, although the terms "first," "second," etc. may be used to describe various elements, these elements should not be limited by these terms. These terms are only used to distinguish one element from another. For example, a first element could be termed a second element, and, similarly, a second element could be termed a first element, without departing from the scope of the embodiments.

It will be understood that, in the description herein and throughout the claims that follow, the terms "comprise" or "comprising," "include" or "including," "have" or "having,"

"contain" or "containing" and the like used herein are to be understood to be open-ended, i.e., to mean including but not limited to.

It will be understood that, in the description herein and throughout the claims that follow, the phrase "and/or" includes any and all combinations of one or more of the associated listed items.

It will be understood that, in the description herein and throughout the claims that follow, words indicating direction used in the description of the following embodiments, such as "above," "below," "left," "right," "front" and "back," are directions as they relate to the accompanying drawings. Therefore, such words indicating direction are used for illustration and do not limit the present disclosure.

It will be understood that, in the description herein and throughout the claims that follow, unless otherwise defined, all terms (including technical and scientific terms) have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any element in a claim that does not explicitly state "means for" performing a specified function, or "step for" performing a specific function, is not to be interpreted as a "means" or "step" clause as specified in 35 U.S.C. § 112(f). In particular, the use of "step of" in the claims herein is not intended to invoke the provisions of 35 U.S.C. § 112(f).

FIG. 1 is a schematic block diagram of a display device 100 in accordance with one embodiment of the present disclosure. The display device 100 includes a transparent substrate SBT, a scan circuit 110, a data circuit 120, a power source 130, and a pixel array 102. At least one of the scan circuit 110, the data circuit 120, the power source 130, and the pixel array 102 can be disposed on the transparent substrate STB. The pixel array 102 may include a plurality of pixel circuits 104 arranged in a matrix. The scan circuit 110 can sequentially generate a plurality of scan signals G(1), . . . , G(N) and provide the scan signals G(1), . . . , G(N) to the pixel circuits 104 in the pixel array 102 via scan lines, so as to sequentially turn on the sub-pixel circuits 106 in the pixel circuits 104, in which N is an integer. The data circuit 120 can generate a plurality of data signals D(1), . . . , D(M) and provide the data signals D(1), . . . , D(M), via data lines, to the sub-pixel circuits 106 which turn on, in which M is an integer. The power source 130 can provide power signals P(1), . . . , P(M) to the sub-pixel circuits 106 via power lines, in which the power signals P(1), . . . , P(M) may be supply voltages or supply currents. The sub-pixel circuits 106 are driven according to the data signals D(1), . . . , D(M) and the power signals P(1), . . . , P(M) to emit lights. Through such operation, the display panel 100 can display images.

It should be noted that, in this embodiment, the number of the sub-pixel circuits in one pixel circuit is taken as an example. Another number of the sub-pixel circuits in one pixel circuit is within the contemplated scope of the present disclosure.

Figure 2:
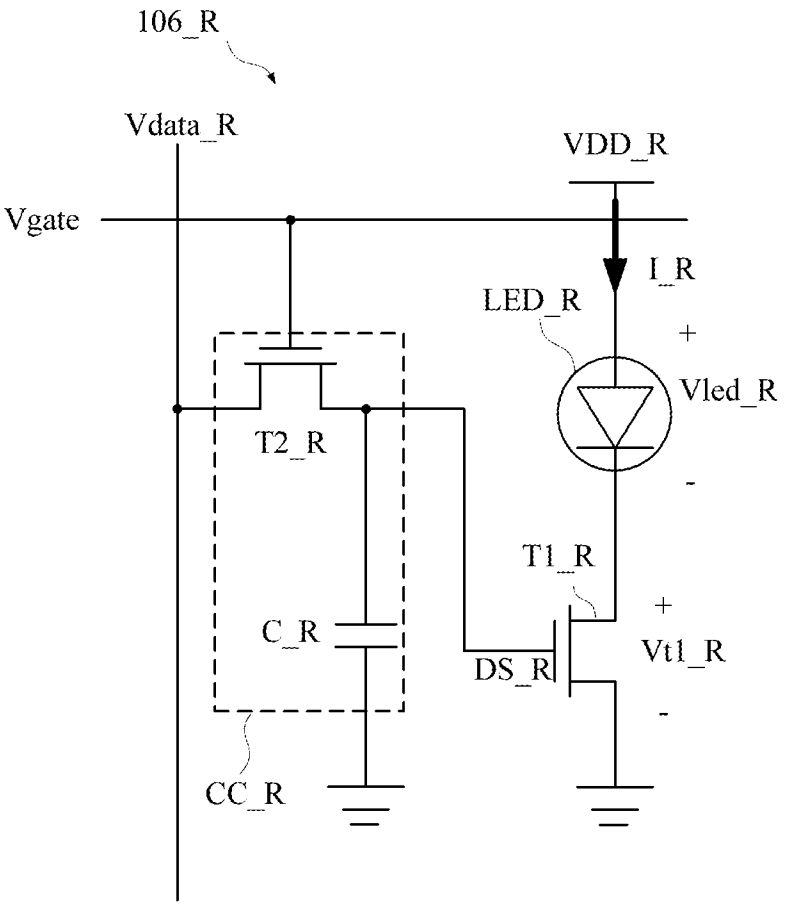
FIG. 2 is a schematic diagram of a sub-pixel circuit in accordance with one embodiment of the present disclosure.

FIG. 2 is a schematic diagram of one of the sub-pixel circuits 106 in accordance with one embodiment of the present disclosure. In this embodiment, the sub-pixel circuit 106_R is taken as a descriptive example. In one embodiment, the sub-pixel circuit 106_R includes a light emitting diode LED_R, an electrically controlled switch (e.g., a driving transistor T1_R), and a control circuit CC_R. In one embodiment, the light emitting diode LED_R may be a red light emitting diode.

In one embodiment, the driving transistor T1_R is serially and electrically connected with a voltage supply (e.g., a voltage supply in the power source 130) having a supply voltage VDD_R and the light emitting diode LED_R. The light emitting diode LED_R is electrically connected between the voltage supply having the supply voltage VDD_R and the driving transistor T1_R. The control circuit CC_R is electrically connected to the gate of the driving transistor T1_R. The control circuit CC_R is configured to provide a driving signal DS_R to the gate of the driving transistor T1_R to drive the driving transistor T1_R according to a data voltage Vdata_R from a data line and a scan signal Vgate from a scan line. When the driving transistor T1_R is switched on, a driving current I_R passes through the light emitting diode LED_R and the driving transistor T1_R according to the driving signal DS_R and the supply voltage VDD_R. At this time, a voltage difference Vled_R, which is substantially equal to (or slightly greater than) the threshold voltage of the light emitting diode LED_R, is presented on two end of the light emitting diode LED_R, and a voltage difference Vt1_R is presented on two end of the driving transistor T1_R.

In one embodiment, the data voltage Vdata_R may be one of the data signals D(1), . . . , D(M) illustrated in FIG. 1. The scan signal Vgate may be one of the scan signals G(1), . . . , G(N) illustrated in FIG. 1. The supply voltage VDD_R may be one of the power signals P(1), . . . , P(M) illustrated in FIG. 1.

In one embodiment, the control circuit CC_R includes a transistor T2_R and a capacitor C_R. One end of the transistor T2_R is electrically connected to the gate end of the transistor T1_R. Another end of the transistor T2_R is configured to receive the data voltage Vdata_R. The gate end of the transistor T2_R is configured to receive the scan signal Vgate. The capacitor C_R is electrically connected between the transistor T2_R and the ground.

In one embodiment, the supply voltage VDD_R is a pulse width modulation voltage, and a duty cycle of the supply voltage VDD_R is less than 100%. In one embodiment, under a first condition that the supply voltage VDD_R has a first voltage level (e.g., high voltage level) and the driving transistor T1_R is switched on, the supply voltage VDD_R with the first voltage level drives (activates) the light emitting diode LED_R, so that the light emitting diode LED_R emits light. Under a second condition that the supply voltage VDD_R has a second voltage level (e.g., low voltage level) and the driving transistor T1_R is switched on, the supply voltage VDD_R with the second voltage level fails to drive (fails to activate) the light emitting diode LED_R, so that the light emitting diode LED_R does not emit light.

In such a configuration, the magnitude of the driving current I_R can be increased, so that the quality of the display device 100 can be improved.

In some approaches, the supply voltage is a DC voltage. The driving current has a low magnitude to avoid the display device being over bright. However, a low driving current may cause unstable operations of the light emitting diode, and affect the quality of the display device.

However, in one embodiment of the present disclosure, since the supply voltage VDD_R is a pulse width modulation voltage, the magnitude of the driving current I_R can be increased, so that the light emitting diode LED_R can be operated more stable, and the quality of the display device 100 can be improved.

In one embodiment, the magnitude of the driving current I_R can be inversely correlated to the duty cycle of the supply voltage VDD_R.

Figure 3:
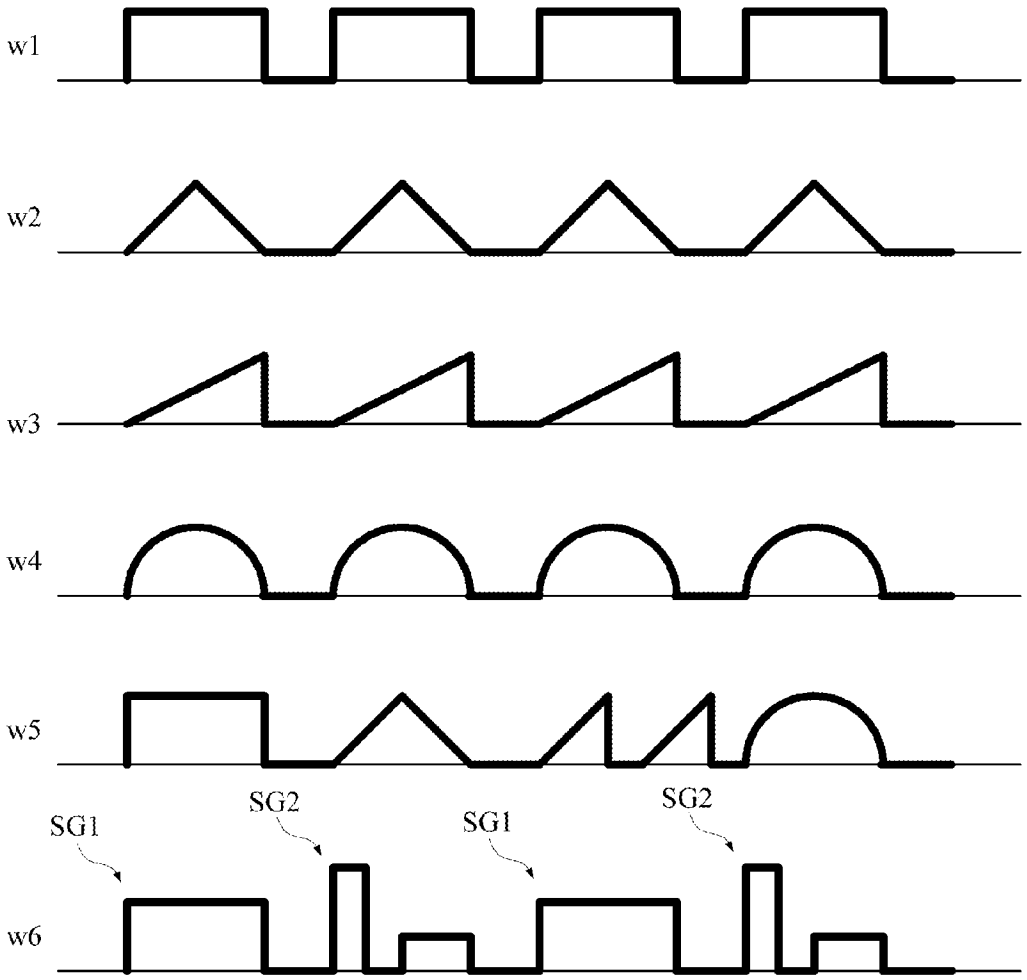
FIG. 3 illustrates different kinds of waveforms in accordance with various embodiments of the present disclosure.

Reference is made to FIG. 3. In one embodiment, the supply voltage VDD_R is a periodical voltage. In one embodiment, the supply voltage VDD_R has rectangular waves (see waveform w1). In one embodiment, the supply voltage VDD_R has triangular waves (see waveform w2). In one embodiment, the supply voltage VDD_R has sawtooth waves (see waveform w3). In one embodiment, the supply voltage VDD_R has sine waves (see waveform w4). In one embodiment, the supply voltage VDD_R has a combination of at least two of sine waves, rectangular waves, sawtooth waves, and triangular waves. (see waveform w5).

In one embodiment, the supply voltage VDD_R includes a first periodic signal SG1 and a second periodic signal SG2 (see waveform w6). In one embodiment, phases of the first periodic signal SG1 and the second periodic signal SG2 are different. In one embodiment, duty cycles of the first periodic signal SG1 and the second periodic signal SG2 are different. In one embodiment, magnitudes of the first periodic signal SG1 and the second periodic signal SG2 are different.

In one embodiment, the supply voltage VDD_R is alternatively converted between more than one voltage levels (see waveforms w1-w6). In one embodiment, the supply voltage VDD_R is converted between more than one voltage levels periodically.

It should be noted that, the waveforms of the supply voltage VDD_R described above are for illustration purposes, and another waveform is within the contemplated scope of the present disclosure.

Figure 4:
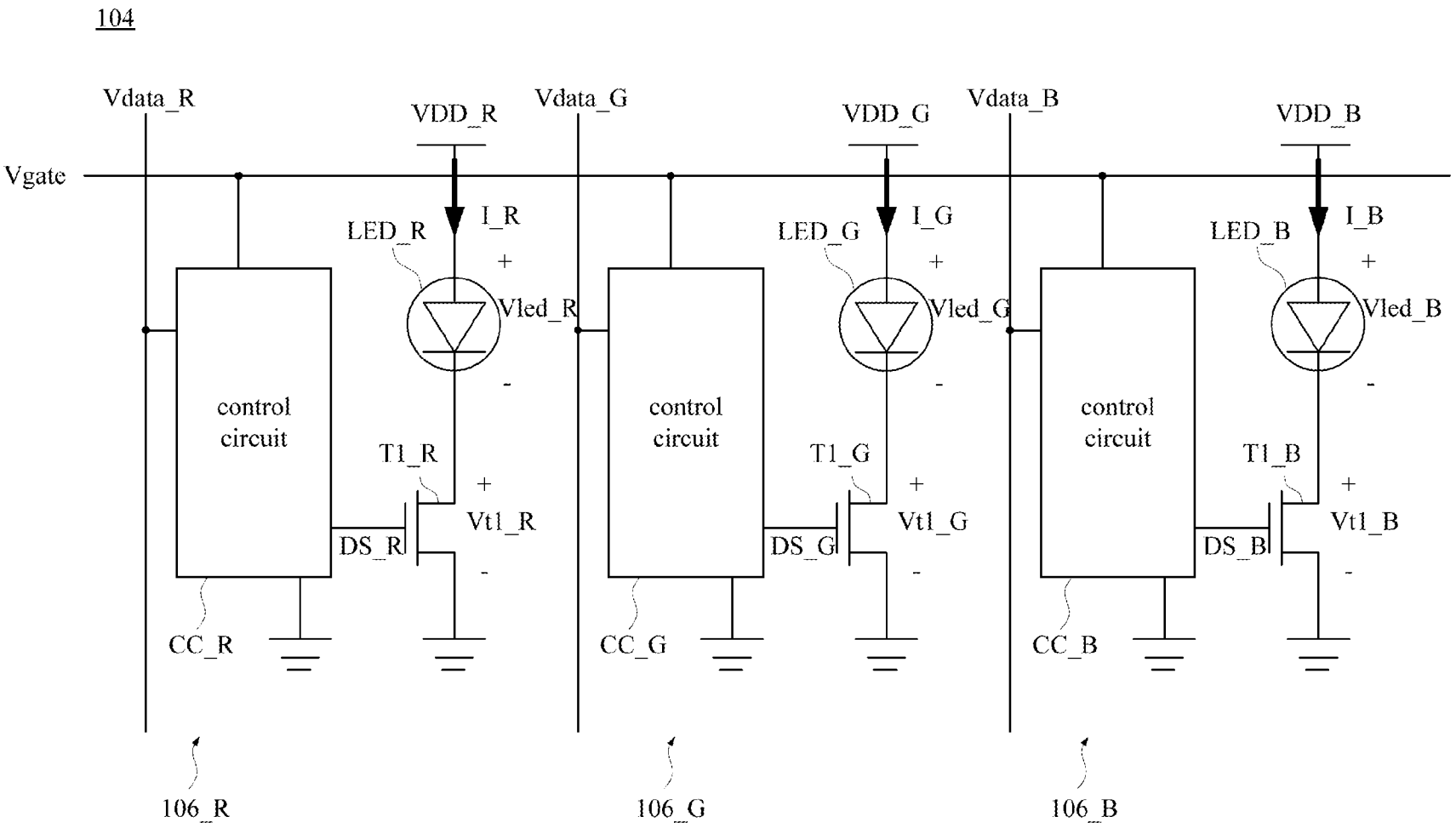
FIG. 4 is a schematic diagram of a pixel circuit in accordance with one embodiment of the present disclosure.

FIG. 4 is a schematic diagram of the pixel circuit 104 in accordance with one embodiment of the present disclosure. In one embodiment, the pixel circuit 104 includes sub-pixel circuits 106_G, 106B and the sub-pixel circuit 106R described above. In one embodiment, the light emitting diode LED_G may be a green light emitting diode, and the light emitting diode LED_B may be a blue light emitting diode.

In one embodiment, the driving transistor T1_G is serially and electrically connected with a voltage supply (e.g., a voltage supply in the power source 130) having a supply voltage VDD_G and the light emitting diode LED_G. The light emitting diode LED_G is electrically connected between a voltage supply having the supply voltage VDD_G and the driving transistor T1_G. The control circuit CC_G is electrically connected to the gate of the driving transistor T1_G. The control circuit CC_G is configured to provide a driving signal DS_G to the gate of the driving transistor T1_G to drive the driving transistor T1_G according to a data voltage Vdata_G from a data line and the scan signal Vgate from a scan line. When the driving transistor T1_G is switched on, a driving current I_G passes through the light emitting diode LED_G and the driving transistor T1_G. At this time, a voltage difference Vled_G, which is substantially equal to (or slightly greater than) the threshold voltage of the light emitting diode LED_G, is presented on two end of the light emitting diode LED_G, and a voltage difference Vt1_G is presented on two end of the driving transistor T1_G.

In one embodiment, the data voltage Vdata_G may be one of the data signals D(1), . . . , D(M) illustrated in FIG. 1. The supply voltage VDD_G may be one of the power signals P(1), . . . , P(M) illustrated in FIG. 1.

In one embodiment, the driving transistor T1_B is serially and electrically connected with a voltage supply (e.g., a voltage supply in the power source 130) having a supply voltage VDD_B and the light emitting diode LED_B. The light emitting diode LED_B is electrically connected between a voltage supply having the supply voltage VDD_B and the driving transistor T1_B. The control circuit CC_B is electrically connected to the gate of the driving transistor T1_B. The control circuit CC_B is configured to provide a driving signal DS_B to the gate of the driving transistor T1_B to drive the driving transistor T1_B according to a data voltage Vdata_G from a data line and a scan signal Vgate from the scan line. When the driving transistor T1_B is switched on, a driving current I_B passes through the light emitting diode LED_B and the driving transistor T1_B. At this time, a voltage difference Vled_B, which is substantially equal to (or slightly greater than) the threshold voltage of the light emitting diode LED_B, is presented on two end of the light emitting diode LED_B, and a voltage difference Vt1_B is presented on two end of the driving transistor T1_B.

In one embodiment, the data voltage Vdata_B may be one of the data signals D(1), . . . , D(M) illustrated in FIG. 1. The supply voltage VDD_B may be one of the power signals P(1), . . . , P(M) illustrated in FIG. 1.

In some embodiments, the configurations of the control circuits CC_G, CC_B may be similar to the configuration of the control circuit CC_R, and a description in this regard will not be repeated herein.

It should be noted that the configurations of the control circuits CC_R, CC_G, CC_B is for illustration purposes, and other configurations are within the contemplated scope of the present disclosure.

In one embodiment, the voltage differences Vled_R, Vled_G, Vled_B (i.e., the threshold voltages of the light emitting diodes LED_R, LED_G, LED_B) are different from each other since that the materials of the light emitting diodes LED_R, LED_G, LED_B are different.

In one embodiment, at least two of the supply voltages VDD_R, VDD_G, VDD_B are different from each other, so as to decrease the voltage differences Vt1_R, Vt1_G, Vt1_B.

More particularly, in one embodiment, when the threshold voltage of the light emitting diode LED_R is lower than the threshold voltage of the light emitting diodes LED_G, and the threshold voltage of the light emitting diode LED_G is lower than the threshold voltage of the light emitting diodes LED_B, the supply voltage VDD_R is lower than the supply voltage VDD_G, and the supply voltage VDD_G is lower than the supply voltage VDD_B.

With such a configuration, the power loss on the driving transistors T1_R, T1_G, T1_B can be reduced.

In some approaches, the supply voltages are identical to each other, so that it is not possible to set one of the supply voltages according to a threshold voltage of a corresponding one light emitting diode.

However, in one embodiment of the present disclosure, the supply voltages VDD_R, VDD_G, VDD_B are different from each other and varied according to the threshold voltages of the light emitting diodes LED_R, LED_G, LED_B. Therefore, the voltage differences Vt1_R, Vt1_G, Vt1_B is able to be decreased, and the power losses on the driving transistors T1_R, T1_G, T1_B are able to be reduced.

Table 1 illustrates an illustrative example that the supply voltages that are identical to each other.

| | VDD | Threshold voltage | Vt1 | PTFT/ Ptotal |
|---|---|---|---|---|
| LED_R | 5 V | 1.8 V | 3.2 V | 64% |
| LED_G | 5 V | 2.2 V | 2.8 V | 56% |
| LED_B | 5 V | 2.6 V | 2.4 V | 48% |

In this example, the supply voltage VDD_R corresponding to the light emitting diode LED_R is 5V. The threshold voltage of the light emitting diode LED_R is 1.8V. The voltage difference Vt1_R between two ends of the driving transistor T1_R corresponding to the light emitting diode LED_R is 3.2V. The ratio of the power consumption PTFT_R (e.g., equal to I_R*Vt1_R) of the driving transistor T1_R to the total power consumption Ptotal_R (e.g., equal to I_R*VDD_R) of the sub-pixel circuit 106_R is 64%.

The supply voltage VDD_G corresponding to the light emitting diode LED_G is 5V. The threshold voltage of the light emitting diode LED_G is 2.2V. The voltage difference Vt1_G between two ends of the driving transistor T1_G corresponding to the light emitting diode LED_G is 2.8V. The ratio of the power consumption PTFT_G (e.g., equal to I_G*Vt1_G) of the driving transistor T1_G to the total power consumption Ptotal_G (e.g., equal to I_G*VDD_G) of the sub-pixel circuit 106_G is 56%.

The supply voltage VDD_B corresponding to the light emitting diode LED_B is 5V. The threshold voltage of the light emitting diode LED_B is 2.6V. The voltage difference Vt1_B between two ends of the driving transistor T1_B corresponding to the light emitting diode LED_B is 2.4V. The ratio of the power consumption PTFT_B (e.g., equal to I_B*Vt1_B) of the driving transistor T1_B to the total power consumption Ptotal_B (e.g., equal to I_B*VDD_B) of the sub-pixel circuit 106_B is 48%.

Table 2 illustrates one embodiment of the present disclosure that the supply voltages VDD_R, VDD_G, VDD_B are different from each other.

| | VDD | Threshold voltage | Vt1 | PTFT/ Ptotal |
|---|---|---|---|---|
| LED_R | 4 V | 1.8 V | 2.2 V | 55% |
| LED_G | 4.5 V | 2.2 V | 2.3 V | 51% |
| LED_B | 5 V | 2.6 V | 2.4 V | 48% |

In this embodiment, the supply voltage VDD_R corresponding to the light emitting diode LED_R is 4V. The threshold voltage of the light emitting diode LED_R is 1.8V. The voltage difference Vt1_R between two ends of the driving transistor T1_R corresponding to the light emitting diode LED_R is 2.2V. The ratio of the power consumption PTFT_R (e.g., equal to I_R*Vt1_R) of the driving transistor T1_R to the total power consumption Ptotal_R (e.g., equal to I_R*VDD_R) of the sub-pixel circuit 106_R is 55%.

The supply voltage VDD_G corresponding to the light emitting diode LED_G is 4.5V. The threshold voltage of the light emitting diode LED_G is 2.2V. The voltage difference Vt1_G between two ends of the driving transistor T1_G corresponding to the light emitting diode LED_G is 2.3V. The ratio of the power consumption PTFT_G (e.g., equal to I_G*Vt1_G) of the driving transistor T1_G to the total power consumption Ptotal_G (e.g., equal to I_G*VDD_G) of the sub-pixel circuit 106_G is 51%.

The supply voltage VDD_B corresponding to the light emitting diode LED_B is 5V. The threshold voltage of the light emitting diode LED_B is 2.6V. The voltage difference Vt1_B between two ends of the driving transistor T1_B corresponding to the light emitting diode LED_B is 2.4V. The ratio of the power consumption PTFT_B (e.g., equal to I_B*Vt1_B) of the driving transistor T1_B to the total power consumption Ptotal_B (e.g., equal to I_B*VDD_B) of the sub-pixel circuit 106_B is 48%.

According to Table 1 and Table 2, when the supply voltage VDD_R is lower than the supply voltage VDD_G, and the supply voltage VDD_G is lower than the supply voltage VDD_B to reduce the voltage differences Vt1_R, Vt1_G between two ends of the driving transistors T1_R, T1_G, the power consumption of the driving transistor T1_R, T1_G can be decreased.

Figure 5:
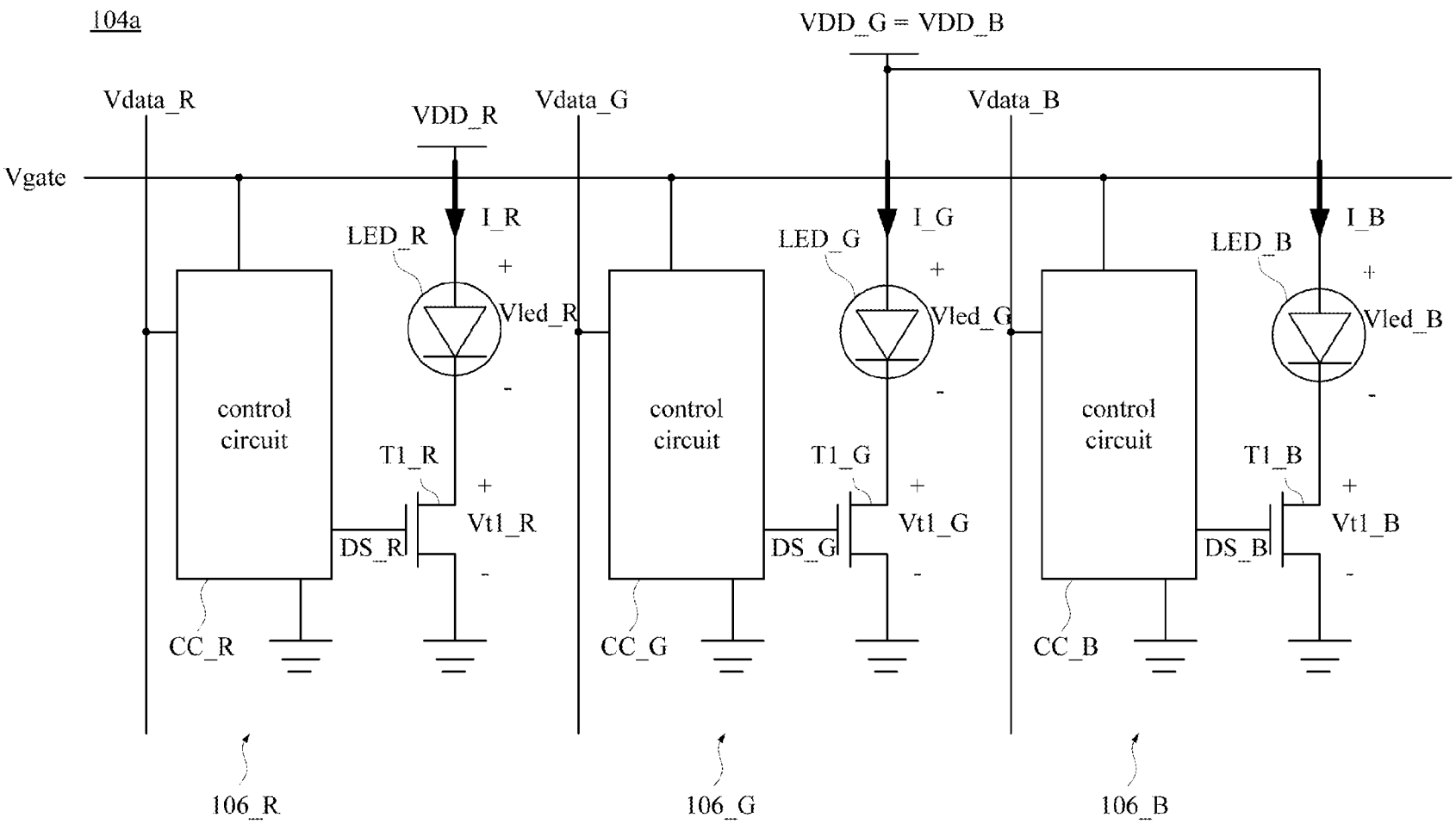
FIG. 5 is a schematic diagram of a pixel circuit in accordance with another embodiment of the present disclosure.

FIG. 5 is a schematic diagram of a pixel circuit 104*a* in accordance with another embodiment of the present disclosure. In one embodiment, the pixel circuit 104*a* can be used to substitute for the pixel circuit 104 shown in FIG. 1. The pixel circuit 104*a* is substantially identical to the pixel circuit 104. Aspects of the pixel circuit 104*a* that are similar to those of the previous embodiment will not be repeated herein.

In this embodiment, two of the threshold voltages of the light emitting diodes LED_R, LED_G, LED_B are substantially equal, and are different from the rest one of the threshold voltages of the light emitting diodes LED_R, LED_G, LED_B.

In this embodiment, the supply voltage VDD_G is equal to the supply voltage VDD_B. In this embodiment, the light emitting diodes LED_G, LED_B are connected to an identical voltage supply that provides the supply voltages VDD_G, VDD_B. The supply voltage VDD_R is different from the supply voltages VDD_G, VDD_B. With such a configuration, if the forward voltages and the threshold voltages of the light emitting diodes LED_G, LED_B are substantially equal, the power loss on the driving transistors T1_R, T1_G can be reduced. In addition, compared to the embodiment shown in FIG. 2, in this embodiment, the area requirement for different power sources for providing different supply voltages can also be reduced.

Table 3 illustrates one embodiment of the present disclosure that the threshold voltages of the light emitting diodes LED_G, LED_B are substantially equal, and the supply voltages VDD_G, VDD_B are identical and are different from the supply voltages VDD_R.

| | VDD | Threshold voltage | Vt1 | PTFT/ Ptotal |
|---|---|---|---|---|
| LED_R | 4 V | 1.8 V | 2.2 V | 55% |
| LED_G | 5 V | 2.4 V | 2.6 V | 52% |
| LED_B | 5 V | 2.6 V | 2.4 V | 48% |

In this embodiment, the supply voltage VDD_R corresponding to the light emitting diode LED_R is 4V. The threshold voltage of the light emitting diode LED_R is 1.8V. The voltage difference Vt1_R between two ends of the driving transistor T1_R corresponding to the light emitting diode LED_R is 2.2V. The ratio of the power consumption PTFT_R (e.g., equal to I_R*Vt1_R) of the driving transistor T1_R to the total power consumption Ptotal_R (e.g., equal to I_R*VDD_R) of the sub-pixel circuit 106_R is 55%.

The supply voltage VDD_G corresponding to the light emitting diode LED_G is 5V. The threshold voltage of the light emitting diode LED_G is 2.4V. The voltage difference Vt1_G between two ends of the driving transistor T1_G corresponding to the light emitting diode LED_G is 2.6V.

The ratio of the power consumption PTFT_G (e.g., equal to I_G*Vt1_G) of the driving transistor T1_G to the total power consumption Ptotal_G (e.g., equal to I_G*VDD_G) of the sub-pixel circuit 106_G is 52%.

The supply voltage VDD_B corresponding to the light emitting diode LED_B is 5V. The threshold voltage of the light emitting diode LED_B is 2.6V. The voltage difference Vt1_B between two ends of the driving transistor T1_B corresponding to the light emitting diode LED_B is 2.4V. The ratio of the power consumption PTFT_B (e.g., equal to I_B*Vt1_B) of the driving transistor T1_B to the total power consumption Ptotal_B (e.g., equal to I_B*VDD_B) of the sub-pixel circuit 106_B is 48%.

According to Table 3, when the threshold voltage of the light emitting diode LED_G substantially equal to the threshold voltage of the light emitting diode LED_B, the supply voltage VDD_R is lower than the supply voltage VDD_G, and the supply voltage VDD_G is equal the supply voltage VDD_B to reduce the voltage differences Vt1_R, Vt1_G between two ends of the driving transistors T1_R, T1_G, the power consumption of the driving transistor T1_R, T1_G can be decreased.

Figure 6:
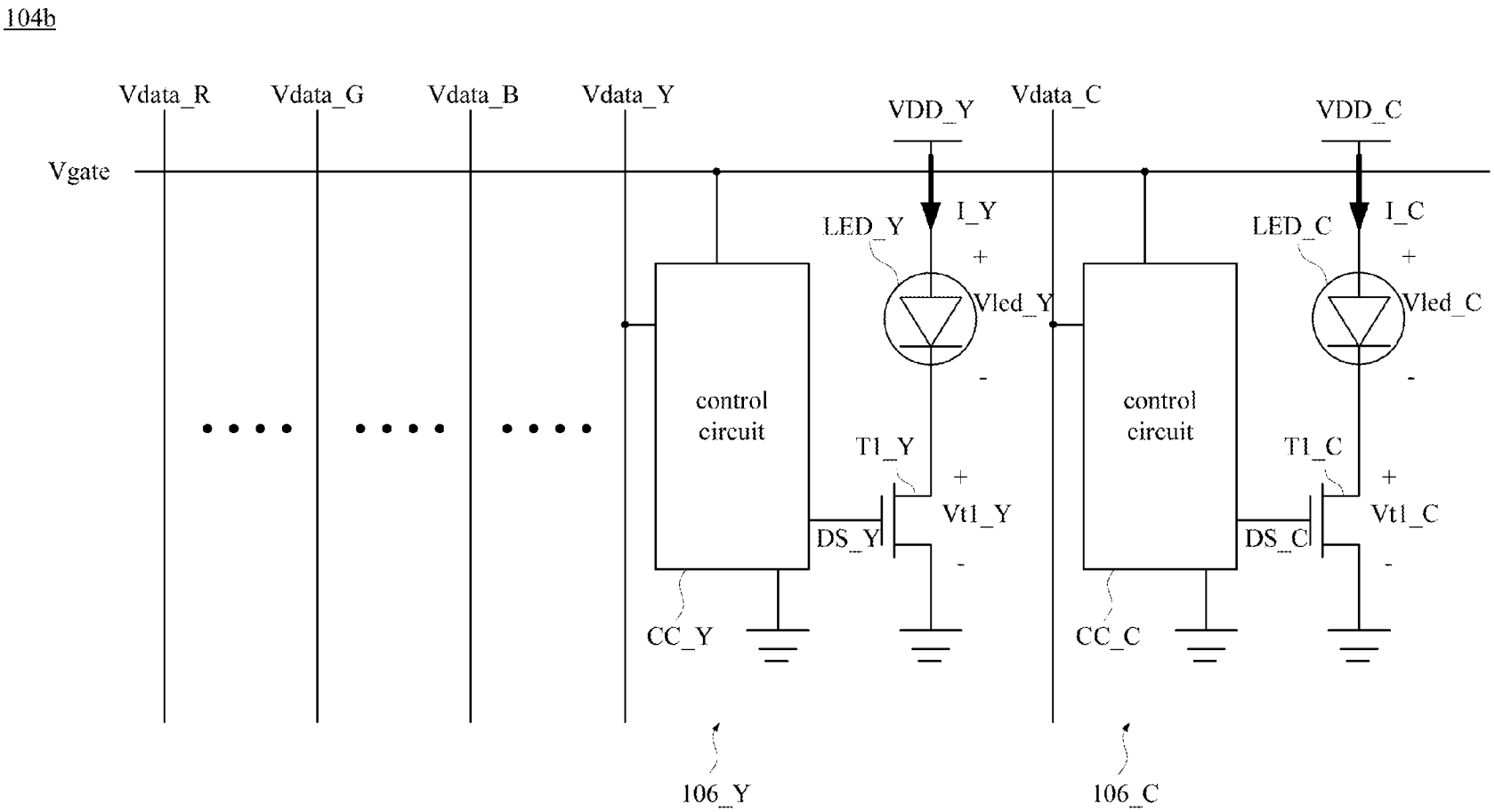
FIG. 6 is a schematic diagram of a pixel circuit in accordance with another embodiment of the present disclosure.

FIG. 6 is a schematic diagram of a pixel circuit 104*b* in accordance with another embodiment of the present disclosure. In one embodiment, the pixel circuit 104*b* can be used to substitute for the pixel circuit 104 shown in FIG. 1. The pixel circuit 104*b* is substantially identical to the pixel circuit 104. Aspects of the pixel circuit 104*b* that are similar to those of the previous embodiment will not be repeated herein.

In this embodiment, in addition to the sub-pixel circuits 106_R, 106_G, 106_B, the pixel circuit 104*b* further includes at least one of sub-pixel circuits 106_Y, 106_C. In this embodiment, the configurations of the sub-pixel circuits 106_Y, 106_C are similar to the configurations of the sub-pixel circuits 106_R, 106_G, 106_B. Therefore, aspects of the sub-pixel circuits 106_Y, 106_C that are similar to those of the sub-pixel circuits 106_R, 106_G, 106_B will not be repeated herein.

In one embodiment, the light emitting diode LED_Y is a yellow light emitting diode. In one embodiment, the light emitting diode LED_C is a cyan light emitting diode.

Under a case that the pixel circuit 104*b* has the light emitting diodes LED_R, LED_G, LED_B, LED_Y, the supply voltages VDD_R, VDD_G, VDD_Y are identical, and different from the supply voltage VDD_B. In one embodiment of such a case, the light emitting diodes LED_R, LED_G, LED_Y are connected to an identical voltage supply that provides the supply voltages VDD_R, VDD_G, VDD_Y.

Under a case that the pixel circuit 104*b* has the light emitting diodes LED_R, LED_G, LED_B, LED_C, the supply voltages VDD_R, VDD_G are identical, the supply voltages VDD_B, VDD_C are identical, and the supply voltages VDD_R, VDD_G are different from the supply voltages VDD_B, VDD_C. In one embodiment of such a case, the light emitting diodes LED_R, LED_G are connected to an identical voltage supply that provides the supply voltages VDD_R, VDD_G, and the light emitting diodes LED_B, LED_C are connected to another voltage supply that provides the supply voltages VDD_B, VDD_C.

Under a case that the pixel circuit 104*b* has the light emitting diodes LED_R, LED_G, LED_B, LED_C, LED_Y, the supply voltages VDD_R, VDD_G, VDD_Y are identical, the supply voltages VDD_B, VDD_C are identical, and the supply voltages VDD_R, VDD_G, VDD_Y are different from the supply voltages VDD_B, VDD_C. In one embodiment of such a case, the light emitting diodes LED_R, LED_G, LED_Y are connected to an identical voltage supply that provides the supply voltages VDD_R, VDD_G, VDD_Y, and the light emitting diodes LED_B, LED_C are connected to another voltage supply that provides the supply voltages VDD_B, VDD_C.

With such a configuration, the power consumption of the display device 100 can be reduced.

Figure 7:
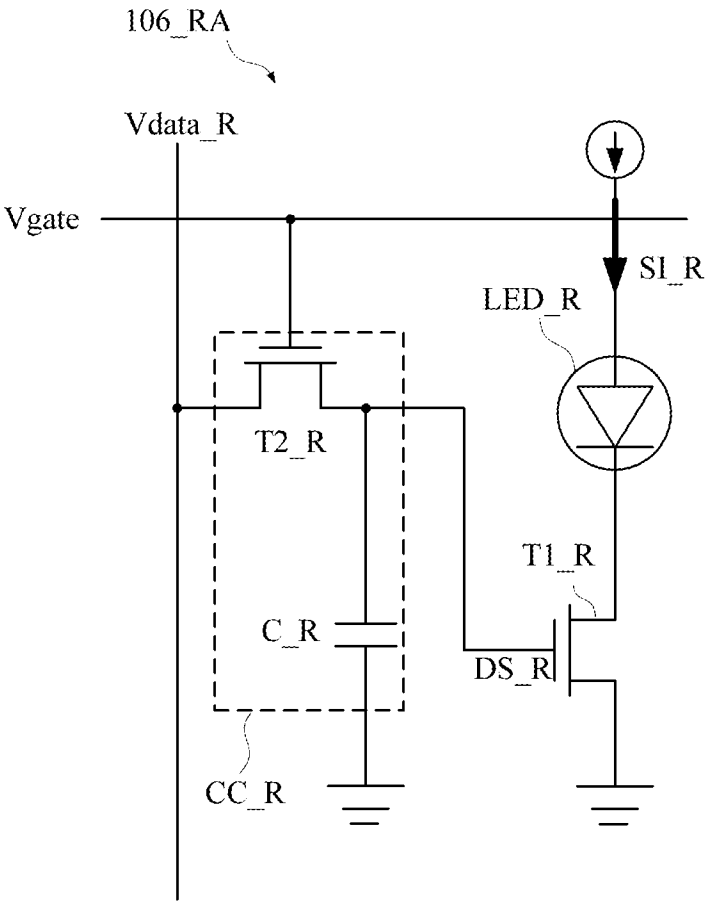
FIG. 7 is a schematic diagram of a sub-pixel circuit in accordance with another embodiment of the present disclosure.

FIG. 7 is a schematic diagram of one of the sub-pixel circuits 106 in accordance with one embodiment of the present disclosure. In this embodiment, the sub-pixel circuit 106_RA is taken as a descriptive example. In this embodiment, the structure of the sub-pixel circuit 106_RA is substantially identical to the structure of the sub-pixel circuit 106_R, and many aspects that are similar will not be repeated herein.

In this embodiment, the driving transistor T1_R is serially and electrically connected with a current supply (e.g., a current source in the power source 130) providing a supply current SI_R and the light emitting diode LED_R. The supply current SI_R is provided to the light emitting diode LED_R to drive the light emitting diode LED_R.

In one embodiment, the supply current SI_R is a pulse width modulation current, and a duty cycle of the first supply current is less than 100%. In one embodiment, under a first condition that the supply current SI_R has a first current level (e.g., high current level) and the driving transistor T1_R is switched on, the supply current SI_R with the first current level drives (activates) the light emitting diode LED_R, so that the light emitting diode LED_R emits light. Under a second condition that the supply current SI_R has a second current level (e.g., low current level) and the driving transistor T1_R is switched on, the supply current SI_R with the second current level fails to drive (fails to activate) the light emitting diode LED_R, so that the light emitting diode LED_R does not emit light.

In such a configuration, the magnitude of the supply current SI_R can be increased, so that the quality of the display device 100 can be improved.

In some approaches, the supply current is a DC current. The supply current has a low magnitude to avoid the display device being over bright. However, a low supply current may cause unstable operations of the light emitting diode, and affect the quality of the display device.

Compared with such approaches, in one embodiment of the present disclosure, since the supply current SI_R is a pulse width modulation current, the magnitude of the supply current SI_R can be increased without making the display device 100 be over bright, so that the light emitting diode LED_R can be operated more stable, and the quality of the display device 100 can be improved.

Reference is made back to FIG. 3. In one embodiment, the supply current SI_R is a periodical current. In one embodiment, the supply current SI_R has rectangular waves (see waveform w1). In one embodiment, the supply current SI_R has triangular waves (see waveform w2). In one embodiment, the supply current SI_R has sawtooth waves (see waveform w3). In one embodiment, the supply current SI_R has sine waves (see waveform w4). In one embodiment, the supply current SI_R has a combination of at least two of sine waves, rectangular waves, sawtooth waves, and triangular waves. (see waveform w5).

In one embodiment, the supply current SI_R includes a first periodic signal SG1 and a second periodic signal SG2 (see waveform w6). In one embodiment, phases of the first periodic signal SG1 and the second periodic signal SG2 are different. In one embodiment, duty cycles of the first periodic signal SG1 and the second periodic signal SG2 are different. In one embodiment, magnitudes of the first periodic signal SG1 and the second periodic signal SG2 are different.

In one embodiment, the supply current SI_R is alternatively converted between more than one current levels (see waveforms w1-w6). In one embodiment, the supply current SI_R is converted between more than one current levels periodically.

It should be noted that, the waveforms of the supply current SI_R described above are for illustration purposes, and another waveform is within the contemplated scope of the present disclosure.

Although the present invention has been described in considerable detail with reference to certain embodiments thereof, other embodiments are possible. Therefore, the scope of the appended claims should not be limited to the description of the embodiments contained herein.

What is claimed is:

1. An operating method of a display device, comprising:

providing a first supply voltage to a light emitting diode to make a driving current pass through the light emitting diode;

wherein the light emitting diode is electrically connected with an electrically controlled switch, the electrically controlled switch is electrically connected with a control circuit, the control circuit is configured to drive the electrically controlled switch according to a data signal and a scan signal;

wherein the first supply voltage is a pulse width modulation voltage, a duty cycle of the first supply voltage is less than 100%, the first supply voltage comprises a first periodic signal and a second periodic signal, and phases of the first periodic signal and the second periodic signal are different.

2. The operating method as claimed in claim 1, wherein the first supply voltage is a periodical voltage.

3. The operating method as claimed in claim 1, wherein the first supply voltage has sine waves.

4. The operating method as claimed in claim 1, wherein the first supply voltage has rectangular waves.

5. The operating method as claimed in claim 1, wherein the first supply voltage has sawtooth waves.

6. The operating method as claimed in claim 1, wherein the first supply voltage has triangular waves.

7. The operating method as claimed in claim 1, wherein the first supply voltage has a combination of sine waves, rectangular waves, sawtooth waves, and triangular waves.

8. The operating method as claimed in claim 1, wherein duty cycles of the first periodic signal and the second periodic signal are different.

9. The operating method as claimed in claim 1, wherein magnitudes of the first periodic signal and the second periodic signal are different.

10. A display device comprising:

a transparent substrate;

a plurality of scan lines;

a plurality of data lines; and a plurality of pixels electrically connected to the scan lines and the data lines, wherein at least one of the pixels comprises:

a light emitting diode configured to receive a first supply voltage;

an electrically controlled switch electrically connected with the light emitting diode; and a control circuit electrically connected to the electrically controlled switch, configured to drive the electrically controlled switch according to a data signal from one of the data lines and a scan signal from one of the scan lines;

wherein the first supply voltage is a pulse width modulation voltage, a duty cycle of the first supply voltage is less than 100%, the first supply voltage comprises a first periodic signal and a second periodic signal, and phases of the first periodic signal and the second periodic signal are different.

11. The display device as claimed in claim 10, wherein the first supply voltage is a periodical voltage.

12. The display device as claimed in claim 10, wherein the first supply voltage has sine waves.

13. The display device as claimed in claim 10, wherein the first supply voltage has rectangular waves.

14. The display device as claimed in claim 10, wherein the first supply voltage has sawtooth waves.

15. The display device as claimed in claim 10, wherein the first supply voltage has triangular waves.

16. The display device as claimed in claim 10, wherein the first supply voltage has a combination of sine waves, rectangular waves, sawtooth waves, and triangular waves.

17. The display device as claimed in claim 10, wherein duty cycles of the first periodic signal and the second periodic signal are different.

18. The display device as claimed in claim 10, wherein magnitudes of the first periodic signal and the second periodic signal are different.

19. A display device comprising:

a light emitting diode configured to receive a supply voltage;

an electrically controlled switch electrically connected with the light emitting diode; and a control circuit electrically connected to the electrically controlled switch, configured to drive the electrically controlled switch according to a data signal and a scan signal;

wherein the supply voltage has a duty cycle less than 100%, the supply voltage comprises a first periodic signal and a second periodic signal, and phases of the first periodic signal and the second periodic signal are different.

20. The display device as claimed in claim 19, wherein the supply voltage is alternatively converted between more than one voltage levels.

21. The display device as claimed in claim 19, wherein the supply voltage is converted between more than one voltage levels periodically.

22. The display device as claimed in claim 19, wherein under a first condition that the supply voltage has a first voltage level and the electrically controlled switch is switched on, the supply voltage with the first voltage level drives the light emitting diode, and under a second condition that the supply voltage has a second voltage level and the electrically controlled switch is switched on, the supply voltage with the second voltage level fails to drive the light emitting diode.

23. The display device as claimed in claim 19, wherein the supply voltage has sine waves.

24. The display device as claimed in claim 19, wherein the supply voltage has rectangular waves.

25. The display device as claimed in claim 19, wherein the supply voltage has sawtooth waves.

26. The display device as claimed in claim 19, wherein the supply voltage has triangular waves.

27. The display device as claimed in claim 19, wherein the supply voltage has a combination of sine waves, rectangular waves, sawtooth waves, and triangular waves.

28. The display device as claimed in claim 19, wherein duty cycles of the first periodic signal and the second periodic signal are different.

29. The display device as claimed in claim 19, wherein magnitudes of the first periodic signal and the second periodic signal are different.

30. An operating method of a display device, comprising:

providing a first supply current to a light emitting diode;

wherein the light emitting diode is electrically connected with an electrically controlled switch, the electrically controlled switch is electrically connected with a control circuit, the control circuit is configured to drive the electrically controlled switch according to a data signal and a scan signal;

wherein the first supply current is a pulse width modulation current, a duty cycle of the first supply current is less than 100%, the first supply current comprises a first periodic signal and a second periodic signal, and phases of the first periodic signal and the second periodic signal are different.

31. The operating method as claimed in claim 30, wherein the first supply current is a periodical current.

32. The operating method as claimed in claim 30, wherein the first supply current is has one of sine waves, rectangular waves, sawtooth waves, triangular waves, and combinations thereof.

33. The operating method as claimed in claim 30, wherein duty cycles of the first periodic signal and the second periodic signal are different.

34. The operating method as claimed in claim 30, wherein magnitudes of the first periodic signal and the second periodic signal are different.

35. A display device comprising:

a light emitting diode configured to receive a supply current;

an electrically controlled switch electrically connected with the light emitting diode; and a control circuit electrically connected to the electrically controlled switch, configured to drive the electrically controlled switch according to a data signal and a scan signal;

wherein the supply current has a duty cycle less than 100%, the supply current comprises a first periodic signal and a second periodic signal, and phases of the first periodic signal and the second periodic signal are different.

36. The display device as claimed in claim 35, wherein the supply current is a periodical current.

37. The display device as claimed in claim 35, wherein the supply current is has one of sine waves, rectangular waves, sawtooth waves, triangular waves, and combinations thereof.

38. The display device as claimed in claim 35, wherein duty cycles of the first periodic signal and the second periodic signal are different.

39. The display device as claimed in claim 35, wherein magnitudes of the first periodic signal and the second periodic signal are different.

* * * * *